United States Patent [19]

Rehn et al.

[11] 3,939,635

[45] Feb. 24, 1976

[54] BALLOON LIMITER WITH WETTING MEANS IN A TEXTILE MACHINE

[75] Inventors: Karl-Heinz Rehn, Remscheid-Lennep; Heinz Middelmann, Radevormwald, both of Germany

[73] Assignee: Barmag Barmer Maschinenfabrik Aktiengesellschaft, Wuppertal, Germany

[22] Filed: Feb. 19, 1975

[21] Appl. No.: 551,065

[30] Foreign Application Priority Data

Feb. 21, 1974 Germany ..... 7406049[U]

[52] U.S. Cl. ..... 57/108; 57/35; 57/164

[51] Int. Cl.[2] ..... D01H 13/12; D01H 13/30

[58] Field of Search ..... 57/1, 7, 35, 58.49, 58.83, 57/108, 106, 164

[56] References Cited

UNITED STATES PATENTS

| | | | |
|---|---|---|---|
| 1,907,898 | 5/1933 | Taylor | 57/164 X |
| 3,295,306 | 1/1967 | Rehn | 57/58.83 |
| 3,327,465 | 6/1967 | Nimtz | 57/108 |
| 3,458,983 | 8/1969 | Hamel | 57/164 X |
| 3,638,415 | 2/1972 | Andrews | 57/35 X |

FOREIGN PATENTS OR APPLICATIONS

| | | | |
|---|---|---|---|
| 1,035,638 | 7/1966 | United Kingdom | 57/58.83 |

*Primary Examiner*—John Petrakes

*Attorney, Agent, or Firm*—Johnston, Keil, Thompson & Shurtleff

[57] ABSTRACT

A ballon limiter in a textile machine with wetting means to supply a liquid for treatment of a ballooning thread in its limited path therethrough, the wetting means including a holder fastened over flow openings in the balloon limiter wall, a casing mounted in the holder and containing at least one insert of absorbent material which is impregnated with the treatment liquid and which is provided with projections extending through the flow openings in the balloon limiter wall for direct contact with the ballooning thread, and clamping means to releasably fasten the casing in the holder over the flow openings.

6 Claims, 5 Drawing Figures

BALLOON LIMITER WITH WETTING MEANS IN A TEXTILE MACHINE

In the operation of textile machines, it is common to form a thread or yarn balloon below or following a thread guide eyelet, the balloon being elongated in the direction of the spindle axis or extending around the spindle axis in a symmetrical manner. The so-called "balloon" describes the circular pattern or rotating path of the thread as it is drawn off through the guide eyelet or any similar guide means.

For a number of reasons, it is desirable to keep the diameter of the thread balloon as small as possible. A smaller balloon diameter permits the parts of the machine to be reduced in size and also makes it possible to lower the tension on the thread, such tension becoming a very serious problem if the balloon diameter is too large. It is therefore conventional in commercial textile machines to use ring- or cup-shaped balloon limiters in order to restrict the diameter of each thread balloon. However, highly undesirable effects arise due to the rubbing and friction between the thread and the contacting surfaces of the ring or cup wall over which the thread continuously runs. For example, such frictional contact increases the tensions on the thread or yarn and can cause serious reduction in the tensile strength of the product. Such a disadvantage is especially noticeable in the treatment or processing of fibrous yarns of cotton or wool and also mixed yarns of natural and synthetic fibers such as wool/polyester yarns. Small projecting fiber ends can break off and be whirled or blown around the room by the air stream produced by the rapidly rotating balloon. The resulting fibrous particles finally deposit in a troublesome manner on the machine elements as well as on the thread or yarn so as to unfavorably influence the quality of the final product. Moreover, the thread being abraded along the inner surface of the mantle or cylindrical walls of the balloon limiter discharges or unloads dyestuff and oligomers so as to form a crust or similar solid deposit on the inner wall surfaces. Aside from reducing the rotary speed of the spindle and its balloon, these crust-like deposits cause damage to the thread or yarn.

In order to meet and attempt to overcome these difficulties, it has already been suggested that the balloon limiter be provided with a storage container for a wetting agent which can be used to wet the thread in its passage through the balloon limiter. See German Auslegeschrift (DAS) 1,510,521. As passages or fluid connections for the wetting agent to flow from the storage container arranged on the outer circumference of the balloon limiter wall or mantle into its interior wall surfaces, there are provided small slots, fine bores or hair-thin gaps. Since these relatively fine liquid passages or channels in the metal wall of the mantle wall become clogged with fiber rubbings or so-called "fiber dust" over a period of time, it is important to periodically clean this wetting device. In most cases, it is necessary to dismantle the balloon limiter together with the wetting device from the rest of the textile machine. The operation of the machine must always be discontinued at the thread treating position or unit being cleaned. This work is costly in time and personnel and cannot always be attended to by available service personnel.

Depending upon the particular type of textile machine, such cleaning may also require several neighboring or simultaneously operated spinning or twisting spindles to be shut down at the same time. For wetting systems in which dosing and feed devices are provided to supply the storage container on the balloon limiter, there are circumstances under which the entire textile machine must be taken out of operation. Thus, the operation of balloon limiters equipped with wetting devices has not been very satisfactory and does not permit continuous trouble-free operation in commercial practice.

One object of the present invention is to provide a balloon limiter of the type described above equipped with a wetting device or liquid feed means which may be effectively cleaned or replaced without dismantling or even partially disassembling the balloon limiter itself, i.e. the wall portions which are in running or limiting contact with the thread balloon. It is also an object to permit the continuous undisturbed operation of the other working positions of the same machine, during cleaning, and even to permit at least partial cleaning of a balloon limiter without taking it out of operation.

These objects and their advantages will become more apparent from a careful consideration of the following detailed disclosure of the invention and the particular embodiments thereof illustrated in the accompanying drawing in which.

Figure 1:
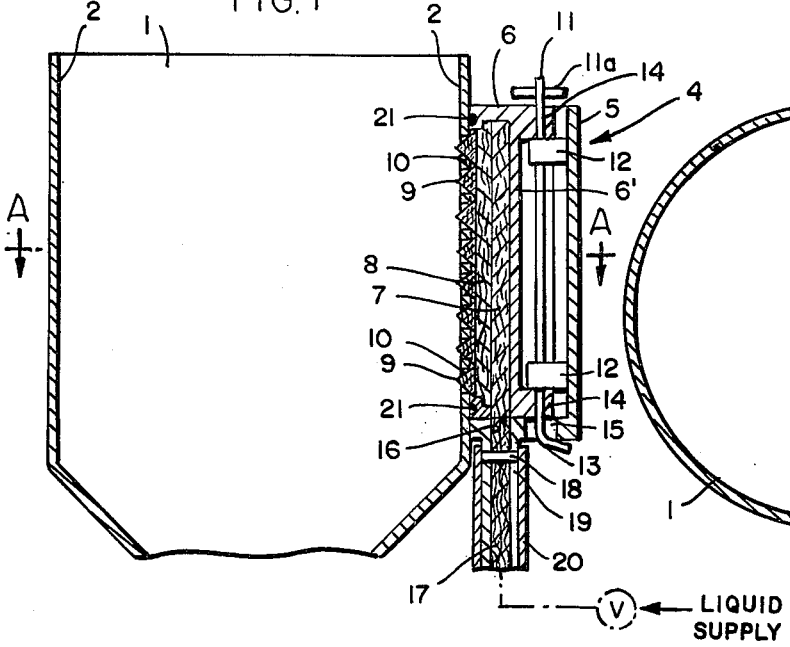
FIG. 1 is a longitudinal section on the axis of a cup-shaped or pot-type of balloon limiter constructed in accordance with the invention with special wetting means in combination therewith.

As illustrated in the drawings and discussed more fully in the following detailed specification, the present invention is generally directed to a textile machine having a balloon limiter of circular cross-section with wetting means to supply a liquid for treatment of a thread conducted through the balloon limiter. The wetting means including a casing which contains at least one liquid impregnated insert arranged over openings in the wall of the balloon limiter to permit a flow of the treatment liquid from the impregnated insert into the interior of the balloon limiter.

The improvement in this apparatus, in accordance with the invention, includes a holder arranged on the outer circumference of the balloon limiter wall and adapted to hold or mount the casing, clamping means to releasably fasten the casing in this holder, and at least one absorbent insert within the casing for transmitting the treatment liquid into the balloon limiter interior, this at least one insert including projections thereon extending through the flow openings in the balloon limiter wall for direct contact with the thread being conducted therethrough. This direct contact can occur tangentially to the thread path of balloon pattern or else the projections can extend slightly in this thread path or balloon pattern.

While the casing with a suitable absorbent insert or preferably a plurality of layered inserts can be removably mounted in the holder, it should be constructed and fastened by the clamping means so that it completely encloses or encases at least one insert in a liquid tight manner, i.e. on all sides except over the flow openings in the balloon limiter wall. Thus, the casing is tightly fastened, i.e. clamped or braced, between the holder and the outer circumference of the balloon limiter wall so as to form a liquid seal around the perimeter of the flow openings in the balloon limiter wall. Such a liquid seal between this wall and the side members of the casing can be accomplished by a gasket or any other suitable sealing means.

The clamping means can be provided in accordance with a number of different embodiments of the invention as discussed in greater detail below, for example using at least one clamping cam fastened onto a locking rod and mounted to lockingly press the casing into its liquid tight or sealed position between the holder and the outer circumference of the balloon limiter wall. The clamping means may also be constructed as a wedge braced or supported on one face by a wedge-shaped portion of the holder with means to releasably tighten the two wedges by drawing them together in axial direction, thereby expanding their effective width or thickness in radial direction. The two co-acting wedges are preferably formed by the back wall of the casing as one wedge and most advantageously by an axially slidable wall of the holder as the other wedge. Yet another clamping means can be provided by a leaf spring or other suitable spring means introduced between an outer cover wall of the holder and the back wall of the casing to releasably press or clamp the casing in place.

The present invention also preferably includes feed means to supply liquid to the absorbent inserts in the casing, i.e. a wick of an absorbent material similar to at least one of the inserts in the casing. It is especially useful to have one insert layer of a number of inserts in the casing serve as a wick leading out of the casing into a suitable liquid supply conduit.

In some instances, it will be desirable to arrange at least two or even more holders to hold a corresponding number of separate wetting means on the outer circumference of each balloon limiter. This permits one to always keep the balloon limiter in operation even though one wetting means is taken out of operation. For example, the wetting device 4 shown in FIGS. 1 and 2 may be duplicated on the opposite side of the balloon limiter 1 over another set of openings in the wall 2. It is also feasible, of course, to arrange these wetting devices one above the other or side-by-side on the outer circumference of the balloon limiter, preferably with a separate valve V controlling the liquid supply to each wetting device.

Figure 2:
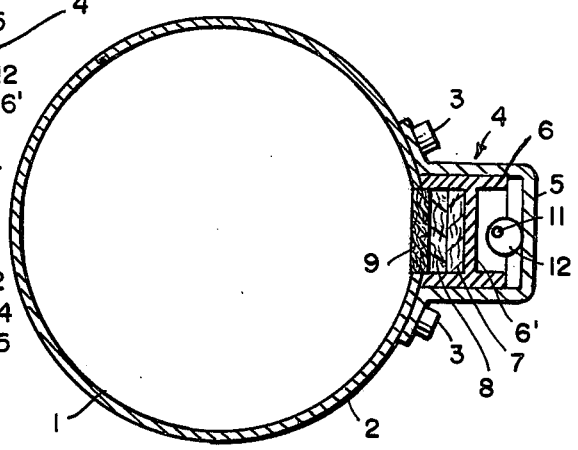
FIG. 2 is a transverse cross-sectional view taken on line A—A of FIG. 1 through the balloon limiter and its wetting means.
Figure 5:
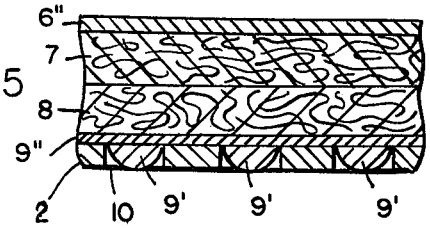
FIG. 5 is a partial sectional view of yet another embodiment of the wetting means.

As will be seen in detail in FIGS. 1 and 2, the balloon limiter 1 has a pot-like shape with a cylindrical upper wall 2 tapering conically inwardly at the bottom, e.g. to approximately follow the thread balloon pattern. By means of machine screws 3 or the like, the wetting device 4 is fastened onto the outer circumference of the wall 2. This wetting device essentially includes the holder 5 and the inner casing member 6 which receives the inset layers of two inserts 7 and 8 as well as an insert consisting essentially of the projections 9 which are preferably made of felt. As shown in FIG. 1, these projections 9 extend slightly beyond the inner surface of the wall 2 through the circumferential slots 10 into the interior of the balloon limiter 1. On the other hand, as shown in FIG. 5, the projections 9′ may also be constructed of a porous sintered metal as the absorbent material of this innermost insert and mounted on an absorbent or similarly porous but flexible backing member 9″ so that the crown of each projection is even with the inner surface of the limiter wall 2, i.e. to be in tangential running contact with the thread balloon limited by this wall 2. Such a crowned or slightly bowed or convex projecting insert 9′ is especially desirable if this insert is a relatively hard and inflexible absorbent material which might tend to damage the thread or yarn. A felt or similar flexible fibrous insert may have any suitable shape fitting into the slots or openings 10.

As indicated in FIGS. 1 and 2, the prism-shaped felt projections 9 extend at their crown or apex by a distance of not more than about 1 millimeter into the circular interior of the balloon limiter 1, i.e. with reference to the inner diameter of the cylindrical wall 2.

The prism-shaped felt projections 9 or sintered metal inserts 9′ (FIG. 5) and their slots 10 are arranged parallel to one another in the wall 2 on planes perpendicular to the balloon limiter axis. The number of inserts and their respective slots depends upon the height of the pot-like balloon limiter 1 or upon the length over which the thread balloon moves in at least occasional running contact with the balloon limiter wall 2.

An important element or assembly of the wetting device according to the invention is the clamping means which permits the casing 6 containing inserts 7 and 8 to be releasably fastened or clamped in place in direct contact with inserts 9 over the openings 10. The casing 6 is thus removable from the holder 5 but can be fixed in place during normal operation.

As illustrated in FIGS. 1 and 2, the clamping means includes the locking pin or rod 11 which is supported by bores 14 and turnable in the casing 6 by means of the handle 11a in order to rotate the eccentric clamping cam 12 from an open position where the casing is axially movable or slidable in holder 5 to the closed or locked position shown in the illustrated embodiment. The locking finger 13 at one end of rod 11 passes through a cutout 15 in the holder 5 to be tensioned in locking position as shown on the side wall of the holder or by locking with any other suitable arrangement to prevent the release of cam 12 during operation of the textile machine.

Such clamping means are not only advantageous in providing a quick release and locking mechanism for rapid interchange of the locked parts but in addition serve to ensure a liquid tight closure or connection of the interchanged parts especially casing 6, with the balloon limiter wall 2. A sealing strip or packing cord 21 can be provided in the wall contacting surfaces of the casing 6 to achieve a completely liquid tight sealing on the wall 2. A rubber O-ring or the like may also be used as this sealing strip to provide an elastic or resilient joint which need not be replaced after each removal of the casing. These and similar conventional sealing means can be readily adopted for purposes of achieving a liquid tight casing around the liquid impregnated inserts externally of the balloon limiter 1.

In order to supply liquid to the wetting device when it is locked in place, the feed bore or inlet channel 16 contains a wick 17 which can be held by the transverse pin 18 in the short feed pipe or nipple 19 to prevent movement of the wick in axial direction. Connected to the nipple 19 on the holder 5 is a flexible, tubular feed conduit 20, for example a transparent plastic tube or the like which can be stretched in diameter to fit tightly on the nipple 19.

The wick 17 extends into a main feed line (indicated schematically) which supplies the treatment liquid used as a wetting agent for the yarn, e.g. water, a finishing preparation, lubricant or other liquid as commonly required for threads, yarns or the like. This main feed line can also be connected to a main supply vessel or manifold containing the liquid used for servicing a large number of individual wetting devices on individual balloon limiters of the same textile machine or even on different machines, e.g. typical spinning and twisting machines and especially two-for-one twisting machines.

The wick 17 terminates upon entry into the holder 5. However, the wick extends sufficiently far into the holder bore 16 so that it comes into liquid transmitting contact with the absorbent insert 7 and is placed thereagainst under some degree of pressure due to the application of the locking finger 13 on the lower end wall of holder 5, thereby drawing the casing 6 up tightly against this end wall. The resulting pressure is also sufficient to create a liquid tight seal between the casing 6 and the holder 5 at this feed entry point. The liquid entering via wick 17 flows through the intermediate layers 7 and 8 of liquid absorbent material and then radially inwardly of the balloon limiter wall 2 through openings or slots 10 by means of the prism-shaped absorbent members 9 projecting very slightly into the interior of the balloon limiter.

The rotating balloon of the thread or yarn takes up the liquid at a steady rate from the projections 9 so that it is not necessary to force the flow of liquid through the wetting device. Instead, there is natural capillary or equalizing effect in the absorbent layers and feed wick which provides a natural flow of liquid at about the same rate at which it is consumed. If desired, some pressure can be exerted through the feed liquid to increase the rate of flow but this is not ordinarily required. As absorbent material for the liquid impregnated wick and the various inserts in the casing, it is possible to use a porous sintered metal but it is especially preferable to use a felt or fibrous web or mat which readily takes up the liquid and transmits it through the wetting device.

In order to interchange the inserts 7, 8, 9, the casing 6 is removed from the holder 5 by rotating the locking rod 11 with the help of the handle 11*a* through an angle of about 90° so that the clamping cam 12 comes free from the back wall of the holder 5 and also so that the locking finger 13 is released from the lower end wall of the holder 5. The casing 6 together with its contents can be drawn off out of the holder 5 in axial direction with reference to the balloon limiter 1. The insertion of a fresh casing 6 which has been prepared in advance and provided with new inserts 7, 8, 9, is accomplished by reversing the steps in order to reassemble and lock the casing 6 in the holder 5. The partly clogged or inefficient inserts 7, 8, 9, of the removed casing 6 can then be exchanged for corresponding new inserts. In some cases, it is sufficient to replace only the prism-shaped projecting inserts 9 because the intermediate inserts 7 and 8 can be reused.

Figure 3:
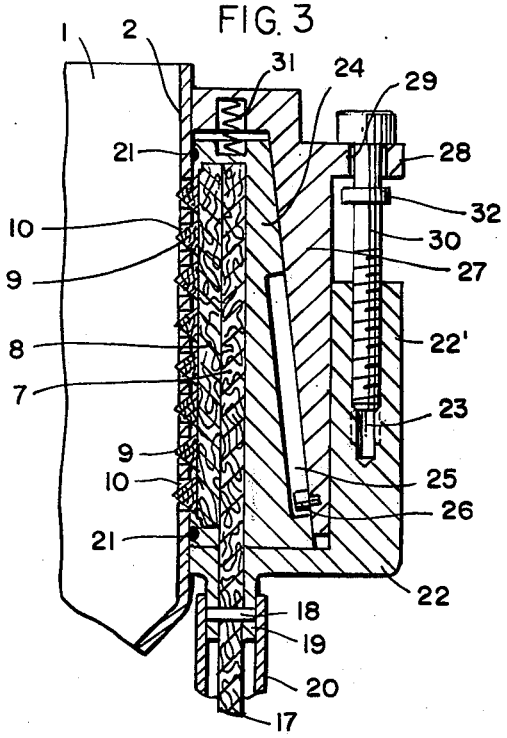
FIG. 3 is a longitudinal section through another embodiment of a wetting means of the invention on the wall of the balloon limiter, part of which is omitted where otherwise similar to FIG. 1.

The embodiment illustrated in FIG. 3 includes the inserts 7, 8, 9, as well as wick 17 with liquid supply means corresponding to the same functional parts in the embodiment of FIGS. 1 and 2. Therefore, such parts or elements have been identified with the same reference numerals. The holder 22 is again fastened by means of screws or the like on the outer circumference of the balloon limiter wall 2. This holder has a tapped bore 23 extending axially in its back wall segment 22′. This tapped bore is adapted to receive a tightening bolt 30 in order to lockingly clamp the wetting device together as will be more fully explained.

The back wall of the casing 24 containing the inserts 7, 8, 9, is bevelled with reference to the outer circumference of the limiter wall 2 and contains a groove 25 which runs on the follower pin 26 connected rigidly in the wedged-shaped clamping member 27. This clamping wedge 27 contains a flange 28 at its upper end with a bore 29 through which the bolt 30 is carried. By tightening the bolt 30 in the tapped hole 23 of holder 22, the clamping wedge 27 is moved between the back wall of the casing 24 on the one hand and the back wall 22′ of the holder 22 on the other hand, in opposition to the force exerted by the spring 31, so that the casing 24 equipped with the sealing means 21 is pressed in liquid tight connection against the outer wall 2 of the balloon limiter.

In order to exchange the inserts or at least part of the inserts 7, 8, 9, the casing 24 is removed from the holder 22 in the embodiment shown in FIG. 3 by loosening the bolt 30. The force of the spring 31 then causes the clamping wedge 27 to move in the direction of the loosened bolt, i.e. so as to move axially upwardly out of its wedged position. Finally, the clamping wedge 27 is completely removed from the holder 22 as the guide ring 32 engages the flange 28 during the upward movement of the bolt 30. The follower pin 26 running in the groove 25 of casing 24 thereby engages the upper end of the groove near the top portion of casing 24 so as to remove this casing together with the inserts 7, 8, 9. A subsequent exchange of the inserts 7, 8, 9, or at least the projecting inserts 9 can then be accomplished as described above in connection with the embodiment of FIGS. 1 and 2.

In the embodiment of the invention according to FIG. 4, the holder 33 is again fastened with screws onto the balloon limiter wall 2. In this case, a cover or cap member 34 closes off the interior of the holder 33 with a liquid tight seal produced by the packing or sealing member 35. By means of a screw 34′ extending into the side wall of the holder 33, the cover 34 is removably fastened onto the holder 33. (One of these screws 34′ is shown with broken lines in the position where it screws into the side wall of the holder.) The cover 34 carries a metal sheet 36 which extends over the entire width of the holder 33 down to the inlet channel or bore 39 where the plastic supply tube 20 is attached. In this embodiment, the sheet-metal casing member 36 acts only as a rigid backing for absorbent inserts 38, 8, 9, arranged in a manner similar to the inserts 7, 8, 9 of the preceding embodiments. The first insert 38 which is directly supported or clamped by the sheet-metal casing 36 is of particular advantage because this insert 38 can be extended outwardly through the channel 39 into supply tube 20 to provide a wick which is identical to the insert 38.

Figure 4:
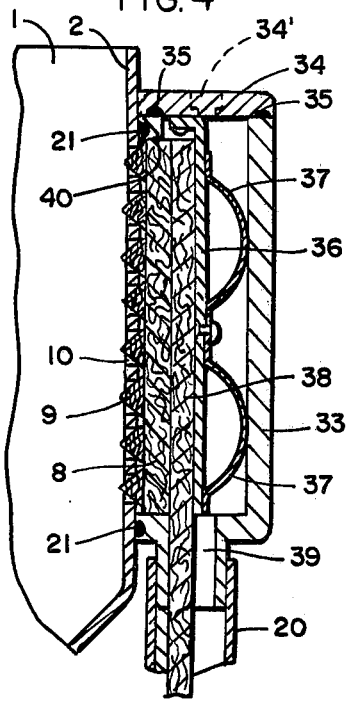
FIG. 4 is a longitudinal section through still another embodiment of the wetting means of the invention in a view otherwise similar to both FIGS. 1 and 3.

The clamping means for the wetting device of FIG. 4 comprises a leaf spring 37 bolted or otherwise fastened to the sheet-metal casing 36 while being pressed against the inner back wall surface of the holder 33. This permits the inserts 38, 8, 9, to be braced between the casing member 36 and the outer circumference of the balloon limiter wall 2 under the relatively light spring pressure of the leaf spring 37. Again, the prism-shaped projections of inserts 9 are clamped firmly in their positions in the slots or openings 10. Also, it is desirable to provide ceiling means 21 between the holder 33 and/or annular collars such as collar 40 which is likewise sealed in closing contact with the cover 34.

The embodiment of the wetting device in FIG. 4 differs not only in providing a wick and intermediate insert 38 as a single piece, but it will be seen that the casing member 36 is provided by a single metal sheet while the holder 33 is completely enclosed around the casing and inserts in liquid tight fashion. Moreover, the combined wick and insert 38 can be drawn off from the upper end of the holder 33 by lifting off the cover 34. The leaf spring 37 does not prevent this axial removal of the casing 36 with the cover 34, and upon reinsertion of a new casing with fresh inserts, this leaf spring 37 is easily depressed to again exert its clamping function. Because the intermediate insert and wick 38 seldom needs to be replaced, only the clogged or spoiled inserts 8, 9, need to be replaced when reinserting the casing 36 with insert 38. The much longer life of the insert 38 thus simplfies the replacement of inserts.

The bore or channel 39 in FIG. 4 is substantially enlarged in comparison to the bores 16 as described in FIGS. 1–3 so that the combined wick and insert 38 can even be retained in the holder 33 when removing the cover 34 with casing member 36 and leaf spring 37. The insert 38 can be permitted to fall over against the back wall of the holder 33 until it is lifted back in front of the reinserted casing member 36.

In all of the illustrated embodiments, the casing member 6 or 36 essentially acts as a bracing or pressure-exerting support member through suitable clamping means between the holder 5, 33 and the casing 6, 36. As will be seen, there are a variety of ways in which the entire wetting device can be assembled and locked in place while still permitting a very rapid exchange of the individual inserts.

This is also true when using the embodiments indicated in FIG. 5 where the projecting inserts 9' are made of a sintered, porous metal adhered to a backing web or sheet 9'' which is also a porous, absorbent material, this combined insert 9', 9'', being pressed in place with the remaining inserts 6'', 7, 8 and clamped as in any of the preceding embodiments. The sintered metal projecting inserts 9' are semi-circular in cross-section and extend into openings 10 so as to be tangential to the inner surface of wall 2. One of the remaining inserts 6'' may also be composed of a porous, sintered metal to provide a reinforced or stronger backing for the inserts 7, 8. In this case, a wick preferably leads into or is identical with the insert 7.

It is quite advantageous for purposes of the present invention to provide the projecting inserts so that they extend at least in the tangential position shown in FIG. 5 or to project slightly further from the openings 10 into the balloon limiter. This structure insures that the treatment liquid is coated in sufficient amounts onto the thread or yarn so as to avoid the disadvantage arising when there is no wetting device on a balloon limiter. The liquid tight connected between the holder or casing of the wetting device and the wall of the balloon limiter permits the twisting spindle to be mounted in any desired position of the machine without danger of the liquid entering into parts of the machine and causing undesirable damage or soiling.

A further advantageous effect of the improvement according to the invention resides in the fact that the previously troublesome and unpleasant cleaning of the wetting device can be accomplished in a very short time interval while the machine is in operation or with only an extremely short stoppage of the machine at the balloon position. This results in a substantial improvement in the quality of the threads being treated without any increase in expense of maintenance or lost time.

A still further advantage of the apparatus constructed as in FIG. 4 resides in the fact that the casing is removed directly with a cover member of an otherwise permanently fastened liquid tight holder, thereby providing very quick access for removal of the spoiled inserts. Also, where one insert also serves as the wick, it can be retained in operation over long periods of time while more frequently exchanging the dirty or spoiled inserts. The cost of maintaining each balloon position are substantially reduced and there are relatively few parts to be handled. Moreover, the relatively large contact surface between the wick and the porous inserts provides a very favorable flow of liquid from a supply source into the wetting device and finally to the balloon limiting surfaces in contact with the running thread balloon.

In order to use spools of large diameter on correspondingly larger spindles, especially two-for-one twisting spindles, it is very desirable to arrange several holders on the outer circumference of a single balloon limiter in order to insure an adequate supply of treatment liquid. This particular use of two or more wetting devices on the same balloon limiter is also recommended when operating at very high linear speeds of the thread or yarn. With such a plurality of wetting devices on the circumference of each balloon limiter, it is also preferable to arrange the openings in the balloon limiter wall in staggered relationship to each other, i.e. at different vertical levels.

Other modifications and variations in the apparatus of this invention can be readily made without departing from the spirit or scope of the invention. The foregoing embodiments are thus intended to be exemplary and not exclusive in defining preferred structure and its operation in accordance with the invention.

The invention is hereby claimed as follows:

1. In a textile machine having a balloon limiter of circular cross-section with wetting means to supply a liquid for treatment of a thread conducted through the balloon limiter, said wetting means including a casing which contains at least one liquid impregnated insert arranged over openings in the wall of the balloon limiter to permit a flow of the treatment liquid from said impregnated insert into the interior of said limiter, the improvement which comprises:

a holder arranged on the outer circumference of the balloon limiter wall to hold said casing;

clamping means to releasably fasten said casing in said holder; and at least one absorbent insert within said casing for transmitting the treatment liquid into the balloon limiter interior, said insert including projections extending through the flow openings in the balloon limiter wall for direct contact with the thread being conducted therethrough.

2. In a textile machine as claimed in claim 1 wherein said clamping means comprises a locking rod operatively connected to a clamping cam turnable to a locked position braced on one side by said holder and indirectly over said casing and said inserts on the other side by said balloon limiter wall.

3. In a textile machine as claimed in claim 1 wherein said clamping means comprises a clamping operatively engaged with threaded bolt means to axially shift the wedge into a locking position braced on one side by said holder and indirectly over a wedge-shaped member of said casing and said inserts on the other side by said balloon limiter wall.

4. In a textile machine as claimed in claim 1 wherein said holder is mounted in liquid tight connection onto said balloon limiter wall and has a removable cover on an upper side thereof for access to said inserts, said casing being mounted on said cover for removal therewith and said clamping means being mounted between said holder and said casing in a closed locking position of said cover.

5. In a textile machine as claimed in claim 4 wherein said clamping means is a leaf spring mounted directly or indirectly on said cover for axial movement into a locking position braced on one side by said holder and indirectly over said casing and said inserts on the other side by said balloon limiter wall.

6. In a textile machine as claimed in claim 4, a liquid supply means for feeding treatment liquid to said inserts including a wick formed by one of said inserts extending through an opening in said holder directly into an attached liquid supply conduit.

7. In a textile machine as claimed in claim 1, a plurality of wetting means, each comprising said holder with a casing, clamping means and at least one absorbent insert, mounted on the outer circumference of each individual balloon limiter.

* * * * *

UNITED STATES PATENT AND TRADEMARK OFFICE

CERTIFICATE OF CORRECTION

PATENT NO. : 3,939,635

DATED : February 24, 1976

INVENTOR(S) : REHN et al

It is certified that error appears in the above-identified patent and that said Letters Patent are hereby corrected as shown below:

In Column 9, Line 4, insert -- wedge -- after "clamping" (second occurrence)

Signed and Sealed this

Fifteenth Day of November 1977

[SEAL]

*Attest:*

RUTH C. MASON
*Attesting Officer*

LUTRELLE F. PARKER
*Acting Commissioner of Patents and Trademarks*